United States Patent [19]

Dyer

[11] 4,018,574

[45] Apr. 19, 1977

[54] PROCESS FOR THE MANUFACTURE OF ENDLESS COATED ABRASIVE ARTICLES

[75] Inventor: Hugh N. Dyer, Loundonville, N.Y.

[73] Assignee: Norton Compay, Worcester, Mass.

[22] Filed: Dec. 16, 1970

[21] Appl. No.: 98,796

[52] U.S. Cl. ..... 51/295; 51/298 A; 51/399

[51] Int. Cl.[2] ..... B24D 11/02; B24D 11/06

[58] Field of Search ..... 51/293, 295, 298, 399

[56] References Cited

UNITED STATES PATENTS

| | | | |
|---|---|---|---|
| 1,788,600 | 1/1931 | Smyser | 51/293 |
| 1,929,274 | 10/1933 | Ellis | 51/399 |
| 2,106,186 | 1/1938 | Mulholland | 51/293 |
| 2,219,853 | 10/1940 | Tone | 51/297 |
| 2,534,805 | 12/1950 | Waterfield | 51/297 |
| 3,014,795 | 12/1961 | Schmidlin | 51/298 |
| 3,037,852 | 6/1962 | White | 51/297 |
| 3,402,034 | 9/1968 | Schnabel | 51/298 |
| 3,413,106 | 11/1968 | Argiro | 51/297 |

*Primary Examiner*—Donald J. Arnold
*Attorney, Agent, or Firm*—Oliver W. Hayes

[57] ABSTRACT

An endless coated abrasive article is formed by helically winding a strip of abrasive material into a spiral of coils, the edges of which are in abutting engagement thus forming a spiral butt joint and coating the inner periphery of the helically wound strip of abrasive material with a continuous layer of resinous composition whereby an abrasive article is formed of greater width than the strip of abrasive material.

4 Claims, 5 Drawing Figures

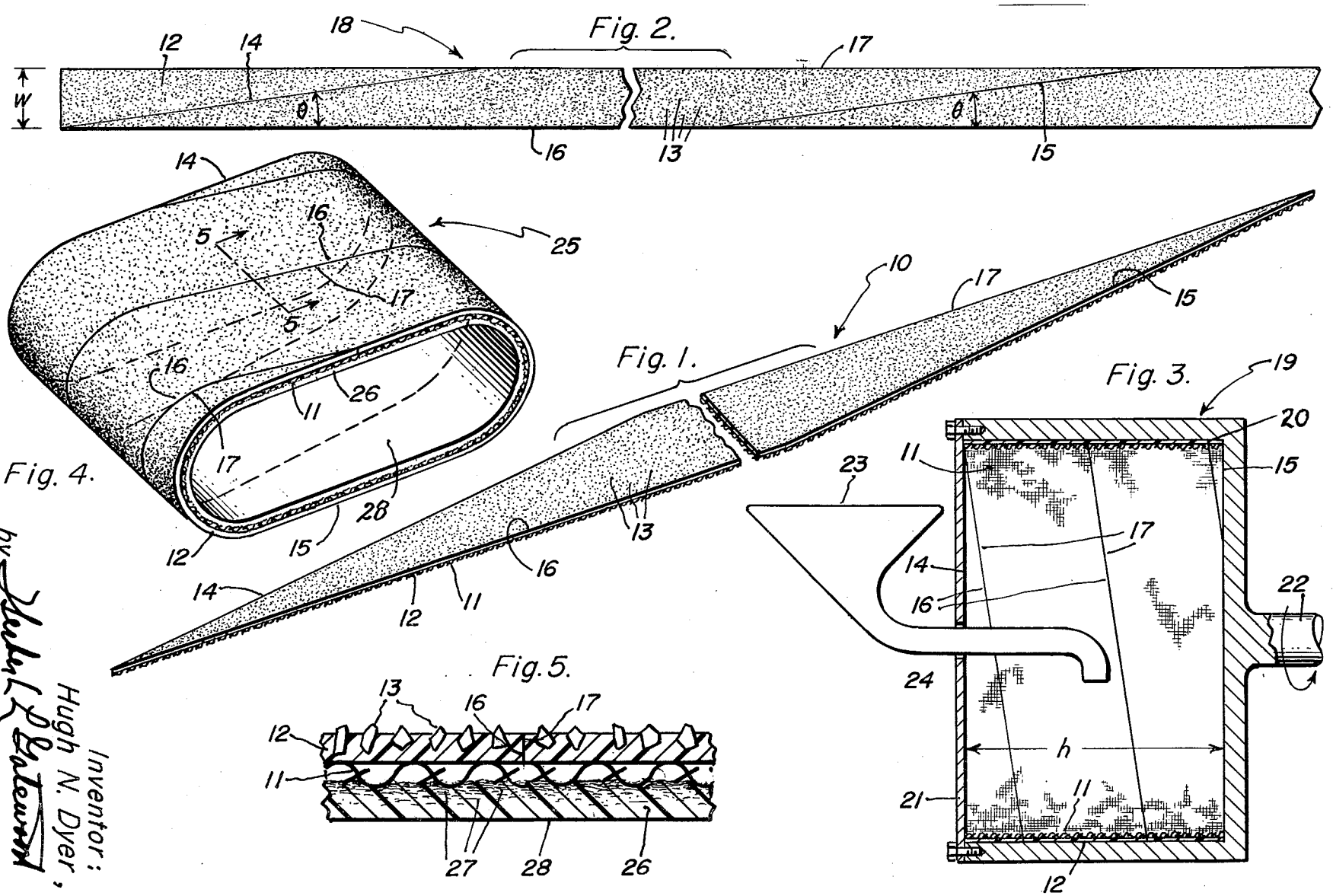
Inventor:
Hugh N. Dyer,
by Herbert L. Gatewood
His Attorney.

PROCESS FOR THE MANUFACTURE OF ENDLESS COATED ABRASIVE ARTICLES

BACKGROUND OF THE INVENTION

1. Field of the Invention

This invention relates to endless coated abrasive articles and to their method of manufacture. In particular, the invention relates to so-called "spiral wound abrasive belts".

2. Description of the Prior Art

Endless coated abrasive articles, such as belts, sleeves, tubes, and the like, are used in a variety of abrading operations thus requiring that such be made and supplied by the coated abrasive manufacturer in a large variety of widths and circumferences.

Coated abrasive belts in most instances are only as wide as the coated abrasive material from which they are manufactured. In the manufacture of these belts, a piece of coated abrasive material, equal in width to the desired belt width, is cut at a suitable angle to its longitudinal direction. In a direction lengthwise, a length equal to the desired belt circumference plus an allowance for forming a lap joint, if such a joint is to be formed, is measured off. A second cut is then made at the same angle as the first. To at least one of the cut ends, after skiving, adhesive composition is applied and the ends are then joined by overlapping and are caused to adhere to one another by means well known to those skilled in the art. Alternatively, the piece of coated abrasive material may be cut to length without the allowance for overlap and the cut ends are butted and joined to one another with an overlapping reinforcing flexible patch suitably adhered to the backside of the two ends of the abrasive material.

This manner of abrasive belt manufacture, as one can readily observe, is limited in the maximum width of endless belt that can be manufactured to the maximum width of available coated abrasive material. Inherent apparatus limmitations in the coated abrasive industry, particularly in the coating apparatus, generally preclude the manufacture of coated abrasive material in widths greater than about 52 inches. However, the productin of steel sheets and the like in widths approaching 100 inches has created a demand for abrasive belts of equal or greater widths. Various attempts, as hereinafter more fully discussed, have been made to provide coated abrasive belts of a width greater than the width of conventionally available coated abrasive material. All of these attempts, to my knowledge, have met with only limited success.

According to one such above-mentioned methods of manufacture of "wider" belts, a piece of coated abrasive material of suitable width is cut at an angle to the length direction, as before. In a direction perpendicular to the cut edge the desired width of the belt is measured off and a second cut is made at the same angle as the first. A second piece is cut congruent with the first and the two pieces are joined along edges parallel with the length direction of the original coated abrasive material, either by forming an overlapping joint or by forming a reinforced butt joint in the manner previously described. By proper choice of width of coated abrasive material, angle of the cut with respect to the length direction of the coated abrasive material, and number of congruent pieces selected, wide, multiple-joint "sectional belts" covering a broad range of belt widths and belt circumferences can be fabricated. However, the necessity of fabricating multiple joints makes the manufacture of these "sectional belts" a relatively expensive process. Moreover, each additional joint in a belt is a potential additional source of belt weakening and a potential additional source of problem with process control and quality of workmanship.

Another method of manufacture of "wider" belts is the "patterned" sectional construction disclosed in Canadian Pat. No. 560,413, issued July 25, 1958, to S. E. Hill and H. N. Dyer, the latter inventor being the inventor in this application. The invention therein disclosed provides a method of manufacture of both sectional belts and single-joint belts, each having maximum strength and minimum stretch in its circumferential direction from a coated abrasive material having a relatively high strength and low stretch in one direction and a relatively low strength and high stretch in the perpendicular direction. Belts made according to this invention, however, have a large number of expensive joints and substantial waste is experienced in cutting the component parts to the required shapes.

Other methods of manufacture of endless "wider" belts and the like are also known. One such method involves winding an inner liner spirally on a mandrel having an outer circumference equal to the inside circumference of the desired abrasive belt, applying an adhesive to the outer surface of the inner liner, and winding spirally over the adhesive layer a strip of coated abrasive material. Such a method is widely used for the fabrication of belts in smaller sizes, up to, for example, 6 inches in diameter or 19 inches in circumference, but has not been found practical or is it widely used fo the fabrication of so-called "wide" belts.

Another method of manufacture of endless coated abrasive articles involving spiral winding is disclosed in Swiss Pat. No. 390,717. Therein an abrasive article of spiral configuration in which the edges abutt one another is disclosed. The joint thus formed is bridged with a metal band or thin synthetic resin film. A spiral would abrasive belt of slightly different configuration is disclosed in U.S. Pat. No. 2,189,754. The joint in the belt therein disclosed has overlapping beveled-edges.

SUMMARY OF THE INVENTION

My invention has as a primary object an improved, endless coated abrasive article. This object is accomplished, in the preferred embodiment, in providing an endless coated abrasive article formed by helically winding a strip of coated abrasive material, the coils thus formed being in abutting engagement, and providing on the inner periphery of the coiled strip of abrasive material a continuous layer of resinous composition.

Quite advantageously, by my invention, coated abrasive belts, bands, sleeves and the like of much greater width than available coatead abrasive sheet material can be provided and, most importantly, these articles can be provided without the problems and disadvantages associated with their manufacture heretofore.

In particular, the manufacture of these relatively wide abrasive articles requires, in the formation of the spiral joint, no scarfing, skiving, backrubbing or other special preparation of the abutting edges. Thus, a potential source of joint weakness is clearly circumvented.

Of further advantagae, the overall thickness of finished endless abrasive articles manufactured in accordance with my invention is uniform throughout. Therefore joint thickness with attendant bumping and surface marking is avoided.

BRIEF DESCRIPTION OF THE DRAWING

The invention will be better understood by referring to the drawing in which like numerals refer to like parts in the various views, and in which:

FIG. 1 is a view in perspective of a strip of coated abrasive material used in the practice of the invention;

FIG. 2 is a top plan view of a length of coated abrasive material from which the coated abrasive strip in FIG. 1 is cut;

FIG. 3 is a view in cross section of a centrifugal mold used in the practice of the invention showing the strip of coated abrasive material in helically wound configuration disposed therein on the inner peripheral surface;

FIG. 4 is a perspective view of a wide spiral wound endless abrasive belt made in accordance with the invention; and FIG. 5 is a cross section of the abrasive belt in FIG. 4, taken at lines 5—5.

DETAILED DESCRIPTION OF THE INVENTION

Referring now to the drawing and first to FIG. 1 thereof, an initial step in the manufacture of an endless coated abrasive article, e.g., a coated abrasive wide belt, according to the invention, is the provision of a strip 10 of coated abrasive material comprising a backing member 11 on the front side of which is adhesively secured by means of bond 12, abrasive grain 13. This strip of abrasive material, having cut or lateral edges 14, 15 and longitudinal edges 16, 17, is cut, as hereinafter more fully disclosed, from a conventional sheet of coated abrasive material 18 of width *w*.

The coated abrasive material used in the practice of my invention is of no particular consequence and is believed to require no detailed disclosure herein. However, in general, the material used for the backing member can be paper, cloth or any other material or combination thereof generally used in the formation of coated abrasive products. Any suitable adhesive, such as glue, resins or the like, may be employed for adhering or bonding the abrasive grain to the backing member. The adhesive bond can include a size coat or not as desired and be of the same composition as the maker adhesive or of a totally different composition. The abrasive grain itself may be any of the desired abrasive materials, such as aluminum oxide, silicon carbide, quartz, emery, flint, garnet, diamonds or combinations thereof, with or without other modifying materials.

In the practice of the invention, a length of coated abrasive material 18 of any convenient width *w* is cut at an angle $\theta$ to its length direction (as shown in FIG. 2) such that the length of the cut edge, i.e., lateral edge 14, is equal to the circumference of the belt, or the like, to be fabricated. By way of example, if the coated abrasive material is 24 inches wide and the circumference of the desired belt is 168 inches, the included angle $\theta$ between cut edge 14 and longitudinal edge 16 is determined by the relation $\sin^{-1} 24/168 = \sin^{-1} 0.143 = 8° 13'$.

A second cut, parallel to the first, is made at a longitudinal distance from the first cut edge that will make the surface area of the strip of coated abrasive material equal to the surface area of the desired abrasive belt. For example, if the circumference of the desired belt is 168 inches and the width is 50 inches, the surface area in this belt is 168 in. × 50 in. = 8400 in.$^2$ Thus where coated abrasive material 18 is 24 inches wide and the first cut edge is 168 inches long, the second cut is made at a distance along longitudinal edge 16 that the altitude of the parallelogram of 168 inch base will be 50 inches. The acute included angle between first cut edge 14 and longitudinal edge 16, as before determined, is 8°13′. Therefore, the second cut edge must be made at a distance along the longitudinal edge from the first cut equal to $50/\sin 8°13' = 50/0.143 = 350$ inches.

In a similar manner, depending on the circumference and width of the belt to be fabricated, and the width of the coated abrasive material with which one starts, one can determine readily the value of the included angle as well as where to make the appropriate cuts.

Strip 10 of coated abrasive material is placed inside an open-ended cylindrical mold 19, with the abrasive-coated surface 13 adjacent to and in contact with the inner peripheral surface 20 of the mold in such a manner as to form, in a sense, a spirally-wound lining for the mold. Longitudinal edges 16, 17 closely butt together, thus forming in the helically wound strip a helical butt joint. Cut edges 14, 15, as shown, determine the circumference of the spiral. If desired, temporary clamps, clips, pressure-sensitive adhesive tape, or the like, not shown in the drawing for sake of clarity, may be used around the edges of the mold to assist in starting and temporarily holding the coated abrasive strip 10 in place.

Open-ended cylindrical mold 19 has a smooth inside surface 20, whose circumference is equal to the desired outside circumference of the endless abrasive belt or the like to be fabricated. The height or altitude of the mold *h* must correspond to the desired belt width or to some convenient multiple thereof. Cover 21 is provided in removable, leakproof engagement, thus permitting, when removed, coated abrasive strip 10 to be positioned, helically, around the mold inner periphery. The mold may be of light-weight construction as, for example, a sheet metal, and is so mounted and supported that it can be rotated about its axis 22.

One will readily observe, it is believed, that while a full end cover for the mold is shown in the drawing, such is not absolutely necessary. A removable ring or interior flange of slightly greater radial thickness than the thickness of the belt to be manufactured will suffice. It is merely necessary, as will hereinafter be seen, to prevent the resinous composition from flowing under the edge of the spiral wound abrasive strip and out of the mold during application of the resinous composition and preliminary cure. However, regardless of the type cover used, it must be removable to permit removal of the finished abrasive belt from the mold.

In certain instances, and to protect the inner peripheral surface of mold 19, it may be desirable to provide a mold liner. Moreover, and in addition to offering protection to the mold surface, the liner will facilitate removal of the newly formed spiral belt from the mold. A suitable liner can be provided from a section of fiber-reinforced plastic pipe having the desired diameter and a thickness on the order of about 0.25 inches. This liner or pipe is desirably split longitudinally into two half-sections in which condition it will facilitate removal of the abrasive belt from the mold liner once the liner-belt combination is removed from the mold. The liner, once the belt is removed, can be reassembled in the mold and reused to manufacture a number of belts of the same size circumference. Where a liner is used, it wil be obvious that the mold diameter must be increased to account for the liner thickness to provide for and accommodate an abrasive belt of the desired circumference.

When strip 10 of coated abrasive material is properly positioned in mold 19 and cover 21 is engaged, the mold is then set in rotation. A resin composition, preferably including a suitable reinforcing material blended therewith in metered proportion, such as chopped fibrous glass reinforcing strands, is then introduced inside the revolving mold through, for example, feed means 23, which extends into the mold through opening 24 in cover 21. As the resinous composition comes into contact with the inner periphery of the coiled coated abrasive strip, the centrifugal force built up by the rotation of the mold causes the resinous mixture to flow radially outwardly displacing the air contained by and in the backing member of the abrasive material. The centrifugal force effects uniform distribution of the resinous composition, resulting in a relatively smooth, uniform resinous layer. The resinous binder and reinforcng fibers quickly rearrange or flow to a position of dynamic equilibrium in the rotating mold. Where the reinforcing fibers or the like are heavier than the resin component, the fibers will tend to gravitate to a position directly adjacent the back side of the backing member of the coated abrasive strip. There they act most effectively as a reinforce, and in particular at the butted edges of the adjacent spiral turns. The lighter resin component fills the interstices between the reinforcing material and tends to form, or curing, a smooth, wear-resistant layer on the inner periphery of the finished coated abrasive belt. Curing, as will hereinafter be further explained, is at least partially accomplished during rotation and before the belt is removed from the mold.

Any resinous material having the desired characteristics of adhesion to the backing member of the coated abrasive material, strength, flexibility and wear-resistance may be used. The resinous composition may be in liquid or plastic form, or in the form of a particulate solid capable of temporarily flowing on heating, or as a coating on the reinforcing material. Preferably, the resinous composition is a liquid comprising a heat curable resin component. Suitable resins for use in the practice of the invention include unsaturated polyesters, epoxy resins, thermosetting acrylics, diallyl phtholate resins, silicones, polyamides and the like. Plastisols and organosols in certain instances, as will be recognized by those skilled in the coating art, are also suitable. Especially useful is a bisphenol -A- fumarate polyester resin such as that commercially available from Atlas Chemical Industries, Inc. under the trade designation "Atlac 382". This resin has superior resistance to heat, water, acids, and alkalies as compared to other conventional polyester resins.

The reinforcing material, which may be from about 5 to about 70%, preferably from about 15 to about 50%, and even more desirably from about 25 to about 40% by weight of the total resinous composition may be of fibrous material, either staple or continous filament, of natural material, for example cotton, sisal, asbestos, etc.; of man-made polymeric fibrous material, for example, nylon, polyolefin, polyester, acrylic, etc., or of man-made inorganic fibrous material such as glass, metal, alumina, silica, silicon carbide, carton, etc.

Nonfibrous material may also be included, if desired, as a part of the reinforcing component. Suitable nonfibrous materials include aluminum silicate, calcium carbonate, magnesium silicate, ceramic zircon, aluminum powder, kaolin, alumina, mica, silica, zirconium silicate, bentonite, etc. Regardless of the resin composition used, sufficient resin composition is introduced into the mold to provide a resin layer of from about 15 to about 20 mils. When a resin layer of suitable thickness is formed on the inner periphery of the helically coiled coated abrasive strip, the resin compnent is cured, during rotation, at least until a resinous film is developed of sufficient strength that the abrasive belt is self-supporting. Further curing, if desired, can be accomplished in a hot air oven or the like after the spiral belt is removed from the mold. Room temperature curing may even be desirable depending upon the particular resin composition used.

Curing time and speed of rotation desired will, of course, differ fo various resinous compositions. However, as a rule of thumb, the speed and duration of rotation should be such as to cause the fibers to pack against the inner periphery of the helically wound strip and lasting until the resinous binder has cured to at least a non-flowable state. Heat may be advantageously applied, e.g., to the inner peripheral surface of the rotating mold by means of an infrared heater or the like, to facilitate curing and to shorten the curing time. Other means of providing heat include heating by a blast of hot air or by direct flame impingement upon the outer peripheral surface of the rotating mold.

When the resinous layer is sufficiently cured, with or without the application of heat, the mold is permitted to come to rest, the cover is disengaged, and abrasive belt 25 is taken from the mold. The resulting spiral wound belt is shown in FIG. 4. This belt, being a plurality of coils of strip 10 of coated abrasive material, has adjacent longitudinal edges 16, 17 in abutting relationship, as shown in FIG. 5. Resin layer 26, forming a continuous uniformly thick layer on the inner periphery of the coiled abrasive strip, bridges the helical butt joint formed by the abutting longitudinal edges. Reinforcing material 27, as shown in the drawing, is packed in a relatively dense stratum against the inner periphery of the backing member of the coiled strip thereby leaving resin layer 26 at its surface 28 smooth and substantially void of reinforcing material.

As an alternative, resin alone may be introduced into the mold, spread into a thin film on the back of the coiled abrasive strip, and partially dried or cured. In a further alternative feature in the practice of the invention, a spiral film or fabric inner lining, similar in shape to the coated abrasive strip, may be placed inside, and in the same manner, as the spirally-wound coated abrasive strip. The liner is adhered to the spiraled strip by a thin, partially cured resin layer previously applied. Additional resin may then be introduced into the mold and spread onto the spiral inner lining under the influence of centrifugal force. The combination liner and resin layer is then further cured as before.

EXAMPLE

In order to provide a better understanding of my invention, and to assist in the proper practice thereof, the following specific illustration of the manufacture of and endless belt 50 inches wide and having a circumference of 168 inches will be helpful.

From a roll of conventional resin bond aluminum oxide abrasive cloth, X weight (24 inches wide), a suitable length of coated abrasive material is withdrawn. This length of material is cut at the free end thereof at an angle of 8°13′ with respect to the longitudinal edge. The cut edge is 168 inches long, the circumference of the desired coated abrasive belt.

At a distance 350 inches from the first cut edge, measured along the longitudinal edge, a second cut is made. This cut, made at the same angle as the first cut, provides an edge of the same length and parallel to the first-cut edge.

The thus-formed parallelogram-shaped strip of coated abrasive material is positioned in helical fashion around the inner periphery of a centrifugal mold. The mold, 53.5 inches I.D., has an internal mold surface height of 50 inches, the width of the desired belt, and is adapted for rotation by means of a shaft connected to a motor according to usual techniques well known to those skilled in the art of centrifugal casting. The internal periphery of the mold is 168 inches, the outer circumference of the desired belt.

The coated abrasive strip, abrasive side in contact with the inner periphery of the mold, is wound so that the spiralling longitudinal edges are in butting engagement. The spirals or helical coils of the strip are held in position and prevented from movement by means of mechanical grippers positioned around the mold periphery.

A liquid curable resinous composition is prepared having the following composition:

| Component | % By Weight Total Composition |
|---|---|
| Atlac 382-05 Resin | 97.4 |
| Cobalt naphthenate (6% Solution) | 0.5 |
| Methyl Ethyl ketone peroxide | 2.0 |
| Dimethyl aniline | 0.1 |

This resin composition and about 35 percent by weight (total composition) glass fibers (0.5–1.5 inches long) are sprayed simultaneously, during mold rotation, onto the inner periphery of the spiralled strip of coated abrasive material. This is accomplished by means of feeding the resinous composition and a glass fiber roving (Owens-Corning Fiberglas roving, Type 825 — individual strand diameter 0.00037 inches, chrome-type sizing) to a Big V Sealzit Spray Gun (Flintkote Company).

The mold, rotating at a surface speed of about 735 feet per minute (about 52 r.p.m.) causes the liquid resinous-fiber composition to flow radially outwardly. Addition of this composition is continued until a layer of uniform thickness (15–18 mils) is formed over the entire inner periphery of the back side of the backing member of the helically wound coated abrasive strip.

While the mold is still rotating, the resinous composition is then heated by means of an infrared radiant heater introduced into the center of the mold. This preliminary curing of the resin component provides a hard, non-tacky film, permitting the belt to be removed, without damage, from the mold.

The mold rotation is then interrupted and thus-formed spiral joint abrasive belt is removed from the mold. Curing of the resin layer is completed in air at room temperature during three days.

On examination, the coated abrasive belt is seen to have a smooth, uniform resin layer on the inner surface thereof. The glass fiber reinforcement is found to be more densely packed closely adjacent the back side of the backing member of the coated abrasive strip thus providing reinforcement of the spiral formed butt joint.

Although as more particularly disclosed, the invention obviously is not limited to formation only of so-called "wide" belts and the like. It is equally applicable to the formation of coated abrasive belts whose width is no greater than the coated abrasive material from which they are manufactured. These belts can be made, it is believed obvious, with a spiral joint or merely a butt joint, as desired. In either event, a uniform resinous layer can be provided which will result in a coated abrasive product having many of the advantages heretofore mentioned.

Having now fully described my invention, it is to be understood that the scope of the invention is intended to be limited only by the disclosure as a whole, including the appended claims.

What I claim is:

1. Process for the manufacture of an endless coated abrasive article comprising the following steps:

a. cutting a coated abrasive material at a first location along the longitudinal edge at an angle to the length direction thereof such that the length of the cut edge is equal to the circumference of the article to be fabricated.

b. cutting said material at a second location along said longitudinal edge and at a predetermined distance from said first location so as to provide a second cut edge parallel to said first cut edge thereby forming a strip of abrasive material having the shape of a parallelogram;

c. winding said strip of abrasive into a spiral comprising a plurality of coils having the abrasive surface on the outside of said coils whereby said longitudinal edge is in abutting engagement with the other longitudinal edge of the parallelogram, said spiralled abrasive strip having an inner and outer periphery;

d. rotating said spiralled abrasive strip about its own axis while said strip is rotating e. applying to said inner periphery smooth, uniformly thick, a resinous composition whereby said composition forms a continuous layer on the inner periphery of the coiled strip of abrasive material; and f. curing said resinous composition thereby providing an endless coated abrasive article of unitary construction and of greater width than said strip of abrasive material.

2. Process as in claim 1 wherein said resinous composition comprises, in addition to a suitable resin, a reinforcing material, said rotation being sufficient to cause a higher concentration of reinforcing material immediately adjacent the inner periphery of the coiled strip of abrasive material.

3. Process for the manufacture of an endless coated abrasive article comprising:

a. positioning a strip of coated abrasive material having a grain side and a back side around the inner periphery of a circular-shaped mold, the back side of said strip material facing toward the mold center;

b. introducing into the mold and onto said back side a resinous composition having therein a fibrous reinforcing material; and c. rotating the mold during introduction of said composition so as to cast on the back side a uniform layer of the resin composition.

4. Process according to claim 3, wherein said coated abrasive strip material is parallelogram-shaped and such is helically wrapped around the iner periphery of said mold.

* * * * *

UNITED STATES PATENT OFFICE

CERTIFICATE OF CORRECTION

Patent No. 4,018,574 Dated April 19, 1977

Inventor(s) Hugh N. Dyer

It is certified that error appears in the above-identified patent and that said Letters Patent are hereby corrected as shown below:

Column 2, line 39; "would" should read - wound -

Column 2, line 66, "advantagae" should read - advantage -

Claim 1, step e; should read - applying to said inner periphery while said strip is rotating a resinous composition whereby said composition forms a continuous layer on the inner periphery smooth, uniformly thick, of the coiled strip of abrasive material; and -

Signed and Sealed this

*Twenty-seventh* Day of *September 1977*

[SEAL]

*Attest:*

RUTH C. MASON
*Attesting Officer*

LUTRELLE F. PARKER
*Acting Commissioner of Patents and Trademarks*